US005386594A

United States Patent [19]

Hilton

[11] Patent Number: 5,386,594

[45] Date of Patent: Feb. 7, 1995

[54] TOILET VENTILATING MANIFOLD SYSTEM

[76] Inventor: David D. Hilton, S. 3824 Sherman, Spokane, Wash. 99203

[21] Appl. No.: 220,363

[22] Filed: Mar. 30, 1994

[51] Int. Cl.[6] ..... E03D 9/052

[52] U.S. Cl. ..... 4/213

[58] Field of Search ..... 4/213, 216, 347, 348, 4/217

[56] References Cited

U.S. PATENT DOCUMENTS

| | | | |
|---|---|---|---|
| 1,931,052 | 10/1933 | Baither | 4/213 |
| 2,297,935 | 10/1942 | Baither | 4/213 |
| 2,619,655 | 12/1952 | Hoff | 4/213 |
| 2,777,137 | 1/1957 | McFadden | 4/213 |
| 2,985,890 | 5/1961 | Baither | 4/213 |
| 3,059,245 | 10/1962 | Bell | 4/213 |
| 3,122,757 | 3/1964 | Sowards | 4/213 |
| 4,222,129 | 9/1980 | Baker | 4/213 |
| 4,365,361 | 12/1982 | Sanstrom | 4/213 |
| 4,494,255 | 1/1985 | Drummond | 4/213 |
| 5,054,131 | 10/1991 | Sim | 4/216 |

*Primary Examiner*—Charles E. Phillips

[57] ABSTRACT

A bathroom ventilation appliance that mounts on existing toilets including: (i) a Toilet Tank Manifold which provides access to the water jackets of the toilet for purposes of drawing odorous air out of the toilet bowl, and supplying water to the Reservoir P-Trap, and providing a mount for a proximity detector switch; (ii) a fan and valve housing that embodies a fan and valve for the purposes of creating a vacuum to draw odorous air out of the toilet bowl and deliver it into the existing sewer vent system of the building, and preventing syphoning of the Reservoir P-Trap water during the flush cycle of the toilet, and to act as a secondary sewer gas back-flow block; (iii) a Reservoir P-Trap which provides primary sewer gas back-flow blockage; (iv) a Toilet Base Manifold for the purposes of providing an exhaust port into the existing sewer vent system of the building; is disclosed wherein the Toilet Ventilating Manifold System is attached to the bottom of an existing toilet base and tank, preventing odorous air from escaping during use of the toilet-i.e. upon activation, the Toilet Ventilating Manifold System delivers odorous air from the toilet bowl into the existing sewer vent system of the building incorporating the P-Trap method of sewer gas back-flow prevention.

4 Claims, 4 Drawing Sheets

1
2
3
4
5
6
7
8
9
9
10
11
12
12

8
20

6
15
14
7
7
13
6
8

8

16
17
18
19
8

WATER TO REFILL P-TRAP
WATER
AIR
WATER
AIR

TOILET VENTILATING MANIFOLD SYSTEM

BACKGROUND OF THE INVENTION

1. Technical Field

The present invention generally relates to bathroom ventilation equipment and more particularly, to toilet ventilators. The Toilet Ventilating Manifold System is an appliance that is installed on existing toilets. It incorporates two plastic manifolds, a fan and solenoid or check valve mounted in a fan housing, a Reservoir P-Trap, an activating switch, and conduit for plumbing the appliance to the existing toilet. The present invention does not use filters or deodorizing wafers, it does not require installation of ventilation ducting and it does not require replacement of an existing toilet as required by older or previously patented systems. Rather, the present invention incorporates a unique manifold design and process of sewer gas back-flow prevention that makes it universally applicable to nearly any style of existing toilet. It finds particularly advantageous use in hospital room bathrooms, apartment or office bathrooms, or any bathroom which lacks a window or where conventional ventilation equipment is not sufficient.

2. Background Art

A. Field of Invention

The conventional method of bathroom ventilation involves the removal of bathroom odors subsequent to the odors departure from the toilet bowl and dispersion in the ambient air. The typical system includes an exhaust fan mounted in the ceiling of the bathroom with ducting leading to the outdoor air. Upon activation, said system attempts to draw odorous air out of the bathroom, at a rate of between 50 and 200 cubic feet per minute (CFM). Said air is then forced through a duct system terminating at a roof or wall vent. Because the odor is removed after its dispersion from the toilet, the conventional ventilation system requires lengthy operation to ventilate the entire bathroom area, as opposed to the present inventions ventilation of the toilet bowl area alone. The conventional systems efficiency is substantially hampered by the constricted air flow dynamics of most bathrooms. In order to remove 50 to 200 CFM of odorous air from the bathroom, an intake of air of that quantity must be provided into the bathroom. Usually this is achieved by an open window or door. However many new home, apartment and office building designs have not provided a bathroom window, and opening the bathroom door to provide air intake allows the odor to escape the bathroom and invade the ambient air defeating the purpose of the ventilation system. Without an adequate air intake into the bathroom, a vacuum is effectively formed in the bathroom by the operating ventilation system thereby substantially restricting ventilation. The Toilet Ventilating Manifold System removes bathroom odors before they escape from the toilet bowl. Therefore it moves far less volume of air then the conventional system and practically eliminates the need for an intake source of air into the bathroom. This results in greatly increased ventilation efficiency and provides substantial energy conservation over the conventional system of bathroom ventilation.

The current building insulating methods used by the construction industry have compounded the problem of providing adequate bathroom ventilation and maintaining indoor air quality. The air tight nature of modern homes and commercial buildings have increased the need for cleaner indoor air. Therefore modern construction designs require more efficient bathroom ventilation systems. The primary objective of the design of The Toilet Ventilating Manifold System is to satisfy this requirement through it's low volume air movement which results in a high efficiency method of ventilation, maximum odor is removed with a minimum of air movement.

In a public bathroom setting, the existence of multiple toilets in a relatively small bathroom area compounds the problem of providing adequate bathroom ventilation. Currently the most often used ventilation system for public bathrooms consist of the operation of a large volume ventilation fan on a continuous basis. This results in inefficient use of electrical energy through the continuous operation of the fan and loss of indoor heated or cooled air. Consequently, the value of the buildings insulation is reduced because of the continuous blowing of indoor heated or cooled air out of the building. This type of bathroom ventilation results in an increase in the operational cost of the building. The Toilet Ventilating Manifold System solves the problem of providing adequate ventilation in a public bathroom. A substantial advantage to the present invention is that the need for a large volume exhaust fan is eliminated because each toilet equipped with said invention would be ventilated prior to the odors escape into the indoor ambient air. As a result conditioned indoor air would remain indoors thereby conserving energy, maintaining the buildings insulation value and reducing operation cost.

Additional ventilation problems exist for bathrooms provided in office buildings. Bathrooms in office buildings are often situated along an interior plumbing wall thereby eliminating the possibility of an outdoor window and making the routing of exhaust ducting for a conventional system inefficient. In commercial buildings, the ventilation fan is required to transport odorous air long distances through exhaust ducting substantially reducing the ventilation fans efficiency. Back pressure resisting the air flow through the system is generated by air friction created through the long lengths of ducting. This back pressure impedes the ventilation fans ability to move air and greatly restricts said systems efficiency. To solve this dilemma deodorant blocks or sprays are often provided. A solution most office workers located near the bathroom area find insufficient. The present invention solves this problem because it vents directly into the buildings sewer vent system which is a high volume duct leading to out-door air. No air flow resistance to the systems operation is encountered because of the low volume of air transported by said invention into the high volume sewer vent system.

B. Description of Art

Several inventors have offered various solutions to the dilemmas of providing adequate bathroom ventilation. One such offered solution is the out-door venting type of system. Exhaust fans have been installed near the toilet with intake ducting provided at or near the toilet seat. The odor collected near the toilet is transported through an exhaust duct system to the out-door air. This is an adequate solution if exhaust ducting has been provided during bathroom construction and the duct run is short enough, usually less than 20 feet, to allow efficient movement of air. However to apply such a system to existing bathrooms requires wall board removal to route the exhaust ducting. This process results in re-construction of the bathroom interior which has proven to be a cost prohibitive step necessary to install this type of bathroom ventilation system. Consequently few of these types of systems are in operation. The Toilet Ventilating Manifold System is distinguished from out-door venting type systems because it does not use exhaust ducting to vent odors to the outdoor air. The present invention vents odors directly into the sewer vent system through a manifold mounted under the toilet. This unique manifold eliminates the need for exhaust ducting and provides an exhaust port directly into the existing sewer vent system of the building. Patents which typify the out-door vent type of bathroom odor ventilators include U.S. Pat. Nos. 3,585,651-Cox; 3,733,619-Smith; 3,824,639-Hunnicutt; 3,902,203-Poister et al; 4,168,553-Studer; 4,175,293-Stephens; 5,029,346-Fernald.

To avoid problems with providing adequate exhaust ducting for toilet ventilation systems some inventors have resorted to recycling the odorous air within the bathroom by propelling said air through deodorizing wafers or filters and exhausting said air into the bathroom. The inherent problems associated with these designs are their questionable efficiency and the continuing need to maintain the systems reliability through replacement of the wafers or filters. In these types of systems odors are often masked rather than eliminated and their efficiency fades with use. An important objective of the Toilet Ventilating Manifold System is to solve these maintenance and efficiency problems by providing a design that is essentially maintenance free and reliable. The system does not use filters or deodorizing wafers to reduce bathroom odors offensiveness. The simplistic design of the system provides a long product life without required regular maintenance. The present invention has a minimum of moving parts, among which is a proven reliable low amperage electrical fan and solenoid or check valve. The fan and valve have been used in industrial application for numerous years and have an excellent reliability record providing the present invention with service free operation under typical use situations. Consequently the consumer is provided with a no maintenance bathroom ventilation appliance that is as reliable as the toilet it services. Patents which typify systems using filters or deodorizing wafers and distinguished from the present invention include U.S. Pat. Nos. 3,824,637-Hunnicutt; 3,781,923-Maisch et al; 4,059,857-Poister; 4,117,559-Boyle.

Yet further steps have been taken in the progression of toilet ventilation systems. To avoid the problems associated with providing exhaust ducting inventors have resorted to drilling exhaust ports into the sewer side of the P-Trap on existing toilet designs. This type of system ducts the odors through said exhaust port and into the existing sewer vent system of the building. See U.S. Pat. No. 4,933,996-Sowards. The standard toilet design has been modified to incorporate the necessary ventilation apparatus including various types of solenoid activated valves. These valves have been assimilated in the exhaust ducting of said system to prevent sewer gas back-flow into the indoor ambient air. Said valves create an inherent problem associated with these modified toilet designs because of the potential failure of the mechanical valves. The valves sealing surfaces operate in the corrosive environment of a typical sewer. Corrosion causing failure of the valve to close would result in sewer gas escaping into the indoor ambient air creating a dangerous and unhealthy situation. Also, an electrical failure of the solenoid operating said valve could potentially result in an explosion. A typical sewer environment often contains the combustible gas methane, and any spark from a failing electrical solenoid valve could conceivably ignite accumulated methane gas and produce disastrous results. In addition systems incorporating mechanical valves for sewer gas back-flow prevention lack the reliability of the long accepted and established P-Trap method of sewer gas blockage. P-Traps are incorporated in existing toilet designs and used on all indoor plumbing. The absence of a P-Trap in toilet ventilation system using mechanical valves for sewer gas back-flow blockage probably disqualifies said systems for use under most plumbing codes. The Toilet Ventilating Manifold System represents the next step of progression in toilet ventilation exhaust ducting. The present invention incorporates a P-Trap to prevent sewer gas back-flow and therefore is qualified for use under plumbing codes. The solenoid or check valve used in said invention operates above the P-Trap in a clean air environment, out of the corrosive and possibly explosive atmosphere of the sewer. This provides an important advantage of the present invention over mechanical valve type systems of sewer gas blockage. Because of the ultimate reliability of the P-Trap design incorporated in the present invention, and the safety it provides by eliminating the existence of electrical equipment within the sewer environment, the Toilet Ventilating Manifold System provides the same protection against sewer gas back-flow and safety of operation that has existed for years with standard toilet designs.

Another disadvantage of toilet ventilator systems incorporating mechanical valves to prevent sewer gas back-flow is that said systems require replacement of an existing toilet with an expensively redesigned toilet accommodating the ventilation equipment. The expense of re-tooling toilet manufacturing facilities to accommodate ventilation equipment into existing toilet designs relegates said designs to a non-cost effective state. Said systems are simply more expensive than most people are willing to pay to remove bathroom odor. As a result few, if any, of these designs are currently on the market. The simplistic design of the present invention avoids an expensive manufacturing process. The manifolds incorporated in said invention are produced by high pressure plastic injection molding, an economical manufacturing process. The other components of the system are inexpensive and readily available, providing the consumer with an economical cost effective solution to the problem of bathroom ventilation. Patents which typify toilet ventilation systems incorporating mechanical solenoid type valves for sewer gas back-flow blockage, and distinguishing the present invention from said systems include U.S. Pat. Nos. 3,740,711-Bond; 4,103,370-Arnold; 4,133,060-Webb; 4,318,192-Williams et al; 4,800,596-Menge; 4,933,996-Sowards.

SUMMARY OF THE INVENTION

A bathroom ventilation appliance that mounts directly on existing toilets including: (i) a Toilet Tank Manifold which provides access to the water jackets of the toilet for purposes of drawing odorous air out of the toilet bowl and diverting water into the Reservoir P-Trap; (ii) a fan and valve housing that embodies a fan and valve for the purposes of creating a vacuum to draw odorous air out of the toilet bowl and deliver said air into existing sewer vent system of the building, and prevent syphoning of Reservoir P-Trap water during the flush cycle of the toilet, and to act as a secondary sewer gas block system; (iii) a Reservoir P-Trap which provides sewer gas back-flow blockage during typical and atypical use of the system; (iv) a Toilet Base Manifold for the purposes of providing an exhaust port into the existing sewer vent system of the building; is disclosed wherein the toilet ventilating system is attached to the bottom of the toilet tank and the bottom of the toilet base providing ventilation of odorous air generated during seated use of the toilet-i.e. the ventilating system does not use ducts to transport odors out of the building, nor does it use filters to remove odors offensiveness, nor does it use mechanical valves to prevent sewer gas back-flow into the building, nor does it require replacement of existing toilets, but, rather it delivers odorous air into existing sewer vent system using the P-Trap method of sewer gas back-flow prevention and incorporating existing bathroom equipment.

It is the general aim of the present invention to provide cost effective, efficient, automatic and quiet bathroom odor removal. The invention preserves the use of existing toilets and supplies bathroom odor removal where it is otherwise not available or existing systems have proven inadequate. Because the present invention does not require replacement of existing toilets or reconstruction of the bathroom interior to accommodate the system, or involve extensive mechanical apparatus, said invention furnishes a low cost simple installation process and cost effective reliable operation.

Another important objective of the present invention is energy efficient removal of bathroom odor. The system is designed to remove odor from the toilet bowl where it originates, before the odor has escaped into the indoor ambient air. Consequently the present invention moves far less air, and uses far less energy than conventional systems which remove odor after it has escaped into the bathroom ambient air. Through the use of a proximity antenna or similar type, switch, the operation of the invention occurs automatically assuring system shut down and preventing wasted operation time.

A further objective of the present invention is a cost effective simple manufacturing process which provides universal and economical application of the present invention to existing bathroom equipment.

A further objective of the present invention is a simplistic design that provides maintenance free operation and long term reliability of the system. The present invention has a minimum of moving parts, among which includes a proven reliable electrical fan and valve assembly which are designed to provide the consumer with maintenance free operation.

A further objective of the system is to provide a plumbing code approved method of toilet ventilation. A modified P-Trap design is used to prevent back flow of sewer gas into the building qualifying the system for use under plumbing code requirements.

In summary the present invention provides a code approved, reliable, energy efficient, safe and cost effective solution to bathroom odor removal. Its simple design assures low cost availability to consumers and universal application to existing bathroom equipment.

DESCRIPTION OF THE DRAWINGS

These and other objectives and advantages of the present invention will become more readily apparent upon reading the following detailed description and upon reference to the attached drawings, in which.

DETAILED DESCRIPTION OF THE SPECIFIC EMBODIMENT

Figure 1:
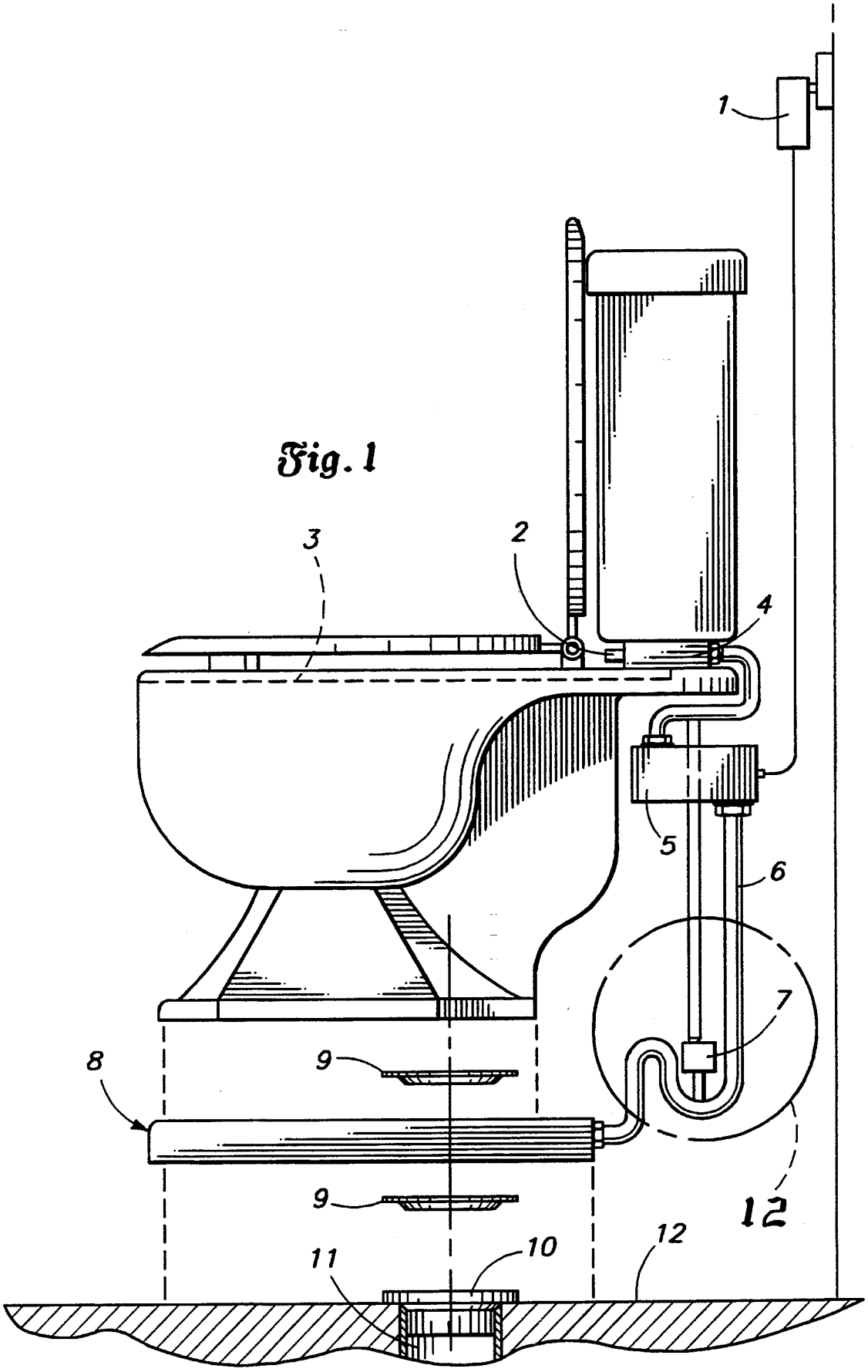
FIG. 1 is an exploded lateral view of a toilet and the Toilet Ventilating Manifold System.

Referring first to FIG. 1 there has been illustrated an exploded view of a toilet with the Toilet Venting Manifold System installed. Indicated at 1 is a standard electrical outlet and the low voltage transformer providing low voltage and amperage electrical power to the fan and solenoid valve of the Toilet Ventilating Manifold System. A low voltage and amperage system is provided to ensure safety in the bathroom environment by eliminating the risk of electrical shock in a situation where the bathroom floor has been flooded with water or any other unusual conditions that might potentially place the electrical power used in the system in contact with the person using the system. Number 2 indicates the location of a motion sensing or light beam switch which activates the system upon seated use of the toilet. Presence of the toilet users body in the field of said switch completes the electrical circuit between the transformer and the system fan and solenoid valve. The fan is then operated causing odor to be drawn out of the toilet bowl and into the system. 3 indicates the water jackets of the toilet rim which are incorporated in the system as air passages for the drawing of odorous air out of the toilet bowl and into the sewer vent system. 4 indicates the toilet tank manifold. Said manifold mounts on the bottom of the toilet tank and provides access to the water jackets of the toilet, allowing air to be drawn out of the toilet bowl and into the Toilet Ventilating Manifold System. The said manifold also diverts a small amount of water from the flush cycle of the toilet to refill the Reservoir P-Trap indicated at 7.

Indicated at 5 on FIG. 1 is the housing of the low voltage fan and solenoid valve or check valve. Upon activation of the system, a fan mounted inside said housing begins to operate and a solenoid opens a valve mounted inside the housing and attached to the PVC pipe indicated at 6. Depending on the capacity of the fan, and the cost of manufacturing, a check valve may be used in place of the solenoid valve, the check valve would be opened by the vacuum drawn by the fan. The operation of the fan in the said housing blows water out of the Reservoir P-Trap indicated at 7, thereby opening the air ways of the system. After emptying the Reservoir P-Trap the activated fan draws odorous air out of the toilet bowl and up through the water jackets 3 of the toilet, the air continues through the toilet tank manifold 4, through the PVC pipe 6 and through the empty Reservoir P-Trap 7. The odorous air is then forced through the toilet base manifold at 8, and into the sewer pipe indicated at 11 and mounted on the bathroom floor as indicated at 12. 9 indicates sleeved wax toilet sealing gaskets used to provide an air and water tight seal between the toilet, toilet base manifold and sewer flange.

The system is deactivated and the low voltage current supplied by the transformer at 1 is terminated by the user of the toilet standing up from the seat and the sensing switch at 2 breaks the electrical circuit provided to the fan and solenoid valve. Without electrical current said fan stops and said solenoid valve or check valve in the fan housing at 7 closes acting as a secondary block to the escape of sewer gas into the system and preventing syphoning of the Reservoir P-Trap water down the sewer with a flush of the toilet. When the toilet is flushed water fills the water jackets and a small portion is diverted into the system to refill the Reservoir P-Trap indicated at 7, creating the primary block to back-flow of sewer gas into the system. If the user of the toilet has failed to flush the toilet, upon deactivation of the system the Reservoir of the Reservoir P-Trap would drain into the P-Trap refilling it and preventing the back-flow of sewer gas through the system. As a secondary security against sewer gas back-flow, the solenoid or check valve located in the housing at 5 would serve to block sewer gas from escaping into the indoor ambient air through the system. The need for the secondary security may arise if the system is caused to operate for an extended period of time (several hours) possibly drying out the reservoir of the Reservoir P-Trap and the system is subsequently shut off. This scenario could potentially result in sewer gas back-flow escaping through the system absent a secondary blockage system. This is not a likely situation but it has been considered in the design of the Toilet Ventilating Manifold System.

Figures 2, 3, 4, 5:
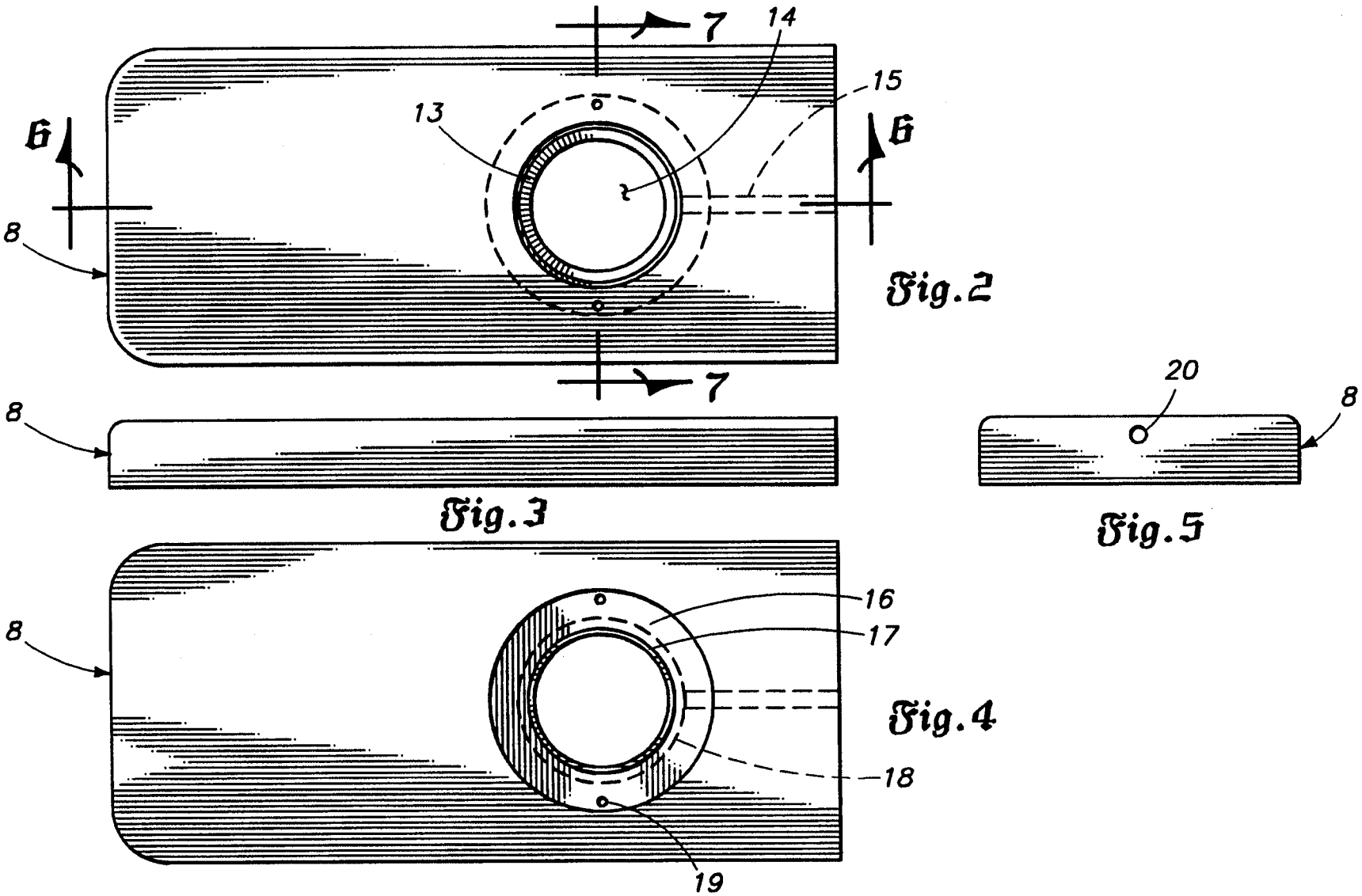
FIG. 2 is an overhead view of the top of the toilet base manifold.
FIG. 3 is a lateral view of the toilet base manifold.
FIG. 4 is a view of the bottom of the toilet base manifold.
FIG. 5 is a rear view of the toilet base manifold.

Referring to FIG. 2 there has been illustrated an overhead view of the top side of the toilet base manifold at 8. The said manifold mounts on the bottom of the toilet and over a toilet mounting sewer flange existing on the bathroom floor as indicated by 10 on FIG. 1. The purpose of said manifold is to provide an exhaust port into the sewer vent system of the building. 13 indicates the recessed flange designed to receive a sleeved wax toilet sealing gasket. The gasket is used to seal the toilet to the toilet base manifold. The sleeved type of sealing gasket is used to direct the flow of waste material away from the exhaust port 15 which enters at the back of the sewer access cylinder 14, this is the point where odorous air is delivered into the existing sewer vent system.

Referring to FIG. 3 there has been illustrated a lateral view of the toilet base manifold. The view demonstrates the general thickness of a base manifold and the additional height, approximately one and one half inches, that a toilet would be elevated after the Toilet Ventilating Manifold System is installed.

Referring to FIG. 4 there has been illustrated a bottom view of the toilet base manifold. Indicated at 16 is the bottom recessed flange designed to receive a wax toilet sealing gasket and a toilet mounting flange as indicated at 10 on FIG. 1. The purpose of the flange is to provide for an air and water tight seal of the Toilet Base Manifold to the existing sewer flange mounted on the bathroom floor. The bottom recessed flange works in conjunction with the top recessed flange shown at 13 FIG. 2 to provide for a water and air tight seal of the toilet to the toilet base manifold and the manifold to the bathroom floor. Indicated at 17 is a tapered protruding lip that fits inside the bottom wax toilet sealing gasket and the existing toilet mounting flange. Said lip provides proper compression of the wax toilet sealing gasket upon installation of the manifold assuring that wax is not compressed into the sewer pipe, shown at FIG. 1, 11, potentially causing blockage of the sewer. 18 indicates the exhaust port groove cut in the toilet base manifold between the top 13 and bottom 16 recessed wax sealing gasket flanges and encircling the sewer access cylinder 14. Said exhaust port groove provides for a protected air flow area for exhaust passage into the sewer. It lies behind the sleeve of a sleeved wax toilet sealing gasket providing for 360 degree air flow into the sewer and reducing the chance of blockage of the system at the exhaust port area of entrance in the sewer access cylinder, shown at 14 FIG. 2. 19 indicates the toilet mounting bolt holes. Toilet mounting bolts are attached to the sewer flange shown at 10 FIG. 1. When the toilet base manifold is mounted on the sewer flange the toilet bolts protrude through the toilet mounting bolt holes of the manifold shown at 19. When the toilet is placed upon the manifold the bolts then protrude through the bolt holes of the toilet where nuts and washers can be installed thereby securing the toilet and manifold to the sewer flange and the bathroom floor. Tightening of the bolts firmly mounts the toilet to the bathroom floor and compresses both the upper wax sleeved toilet sealing gasket and the lower wax toilet sealing gasket providing a water and air tight seal between the toilet, the manifold and the sewer flange.

Referring to FIG. 5 there has been illustrated a rear view of the toilet base manifold. Indicated at 20 is the entrance of the exhaust port which passes through said manifold providing access to the sewer for odor drawn from the toilet bowl and forced into the sewer by the system fan.

Figures 6, 7, 8, 9, 10, 11:
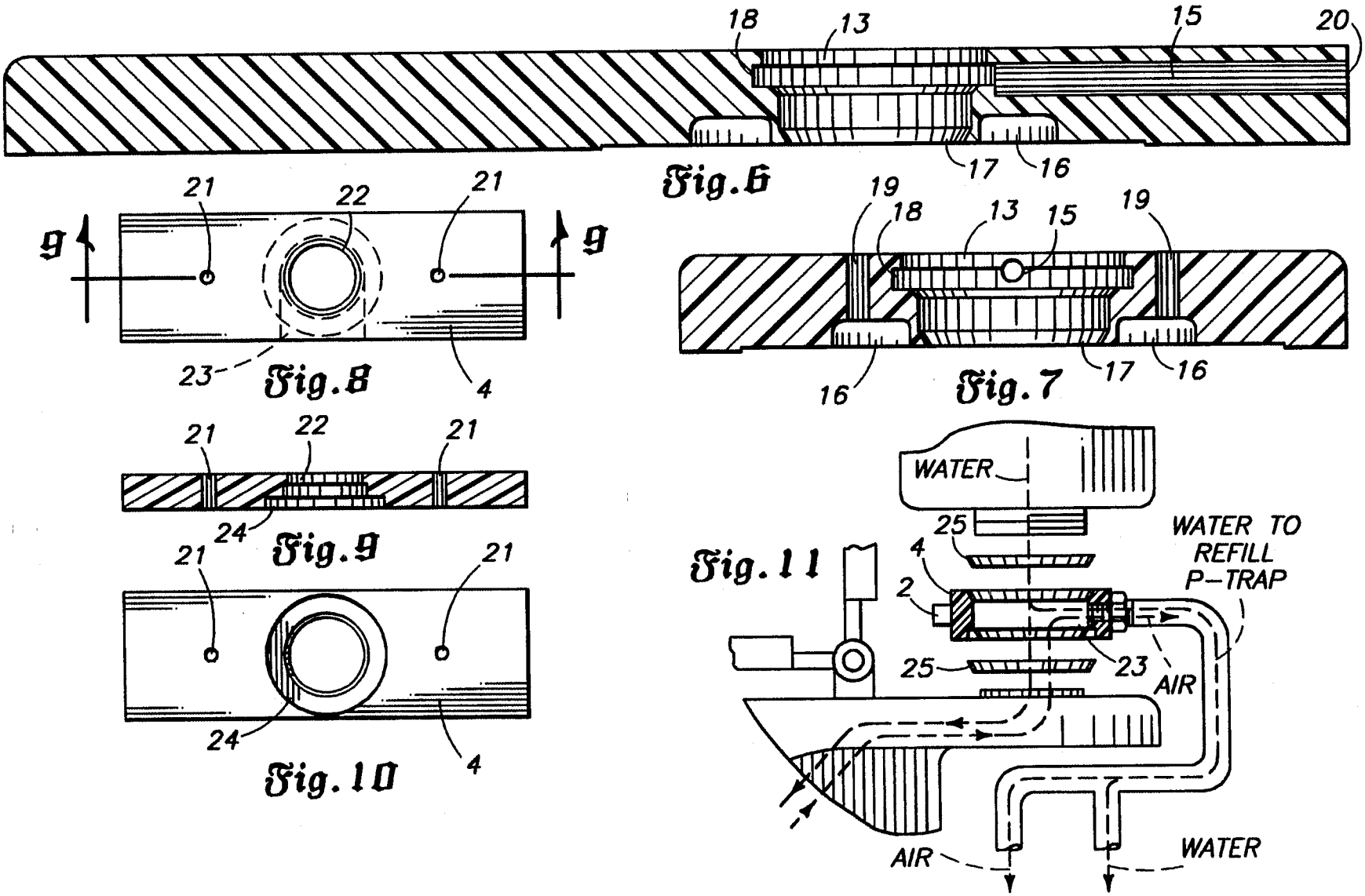
FIG. 6 is a cross section view of the toilet base manifold showing the exhaust port and the sewer access cylinder surrounded on the top and bottom by recessed flanges for sleeved wax toilet sealing rings.
FIG. 7 is a rear cross section of the toilet base manifold showing the toilet mounting bolt holes, the sewer access cylinder encircled by the exhaust port air flow groove and surrounded on the top and bottom by recessed flanges for sleeved wax toilet sealing rings.
FIG. 8 is an overhead view of the top of the toilet tank manifold showing the tank mounting bolt holes, top sealing ring flange and a cut away view of the intake port.
FIG. 9 is a frontal cross section view of the toilet tank manifold showing the tank mounting bolt holes and the top and bottom sealing ring flanges.
FIG. 10 is a bottom view of the toilet tank manifold showing the bottom recesses flange and lip designed to seat a toilet tank sealing gasket.
FIG. 11 is a lateral view cross-section of the toilet tank manifold showing the intake port of the manifold, the top and bottom toilet tank sealing gaskets, the activating switch and water and air flow through the manifold.

Referring to FIG. 6 there has been illustrated a lateral cut away view of the toilet base manifold. 13 indicates the top recessed flange designed to receive a sleeved wax toilet sealing gasket. 18 indicates the exhaust port groove cut in the toilet base manifold surrounding the sewer access cylinder. Said groove is cut approximately ¼ inch deep into the sewer access cylinder beneath the top recessed flange 13 and intersects with the exhaust port providing a 360 degree air flow into the sewer vent system and decreases the chance of blockage of the exhaust port by solid materials passing through the sewer access cylinder from a flushing of the toilet mounted above. The groove is protected by the sleeve of a sleeved wax toilet sealing gasket used to mount the toilet to the manifold. When compressed by mounting of the toilet, the sleeve is compressed partially into the sewer access cylinder and directs waste materials into the center of the sewer access cylinder and away from the exhaust port groove assuring reliable blockage free operation of the system. 15 indicates the exhaust port through which the odorous air is forced into the sewer. Said port is a round or oblong tunnel that passes through the base manifold and it is designed for maximum air volume through the base manifold into the sewer vent system. Said port is approximately ¾ of an inch in diameter and may be increased in size or by number of ports relative to the air flow demands of the system. Indicated at 16 is the bottom recessed flange designed to receive a wax toilet sealing gasket and toilet mounting flange. Indicated at 17 is a tapered protruding lip that fits inside the bottom wax toilet sealing gasket and the existing toilet mounting flange. This lip provides proper compression of the wax toilet sealing gasket upon installation of the manifold assuring that wax is not compressed into the sewer pipe, shown at FIG. 1, number 11, potentially causing blockage of the sewer under the toilet.

Referring to FIG. 7 there has been illustrated a rear cut away view of the toilet base manifold. 13 indicates the top recessed flange for a sleeved wax toilet sealing gasket used to seal the toilet to the toilet base manifold. 15 indicates the junction of the exhaust port and the air exhaust groove indicated at 18. This junction is more oblong than the drawing indicates and is designed for maximum air flow. 19 indicates the toilet mounting bolt holes. Indicated at 16 is the bottom recessed flange for receiving a wax toilet sealing gasket and toilet mounting flange existing on the bathroom floor. Indicated at 17 is the tapered protruding lip that fits inside the bottom wax sealing ring and the toilet mounting flange existing on the bathroom floor. Said lip provides proper compression of the wax sealing gasket upon installation of the system.

Referring to FIG. 8 there has been illustrated a top view of the toilet tank manifold shown at number 4. 21 indicates the bolt holes for the toilet tank mounting bolts which pass through said manifold and the toilet base. Extended length toilet tank mounting bolts are used to attach the toilet tank manifold to the toilet tank, and said manifold and tank to the toilet base. Nuts and washers are attached to the bolts and tightened compressing the sealing gaskets and forming an air and water tight seal between the toilet and said manifold. 22 indicates the top toilet tank sealing gasket flange where the toilet tank spigot seats in the tank manifold. The flange is designed to accept a standard compressible foam type tank sealing gasket to seal the said manifold to the said tank in the same manner that a toilet tank is sealed to a toilet. Indicated at 23 is the intake port of the said manifold. This is a void area in the manifold with an opening groove cut beneath the back concave surface of the top toilet tank sealing gasket flange. The intake port provides the Toilet Ventilating Manifold System with access to the water jackets of the toilet for the purpose of drawing air out of the toilet bowl, through the water jackets and into the system. After a flushing of the toilet said port provides water flow to refill the Reservoir P-Trap at FIG. 12. When the toilet is flushed the toilet tank manifold is flooded with water, most of which proceeds down the water jackets of the toilet in the flush cycle. However a small portion of water is diverted by said manifold into the PVC pipe indicated at 6 on FIG. 1. This portion of the flushing water flows through the system where it refills the Reservoir P-Trap to prevent the back-flow of sewer gas through the system.

Referring to FIG. 9 there has been illustrated a front cross section view of the toilet tank manifold. 22 indicates the top toilet tank sealing gasket flange. 21 indicates the tank mounting bolt holes. 24 indicates the bottom recessed manifold mounting flange for sealing the manifold to the toilet base. This flange incorporates the same sealing gasket type as used to seal the tank to the manifold, and is also used to seal said manifold to the toilet base in the same manner.

Referring to FIG. 10 there has been illustrated a bottom view of the toilet tank manifold. 21 indicates the tank mounting bolt holes. 24 indicates the bottom recessed manifold mounting flange for sealing the toilet tank manifold to the toilet base.

Referring to FIG. 11 there has been illustrated an exploded end cross section view of the toilet tank manifold mounted between the toilet tank and toilet base. Indicated at 4 is the toilet tank manifold. Indicated at 2 is the activating switch. Indicated at 25 are the toilet tank sealing gaskets which seal the toilet tank manifold to the toilet tank and to the toilet base. Indicated at 23 is the intake port through which odor is drawn from the toilet bowl through the water jackets of the toilet. Also indicated at 23 is the air and water flow through the toilet tank manifold which occurs during operation of the system and the flushing of the toilet. During operation of the system, air as indicated by the "AIR" arrows on FIG. 11 is being drawn out of the toilet bowl, through the water jackets of the toilet rim, through the tank manifold 4 and into the fan housing as indicated by 5 on FIG. 1. Upon termination of the system the user flushes the toilet flooding the said manifold and water jackets with water, water to refill the Reservoir P-Trap, FIG. 12, is diverted by said manifold into the PVC pipe indicated at FIG. 11.

Figures 12, 13, 14:
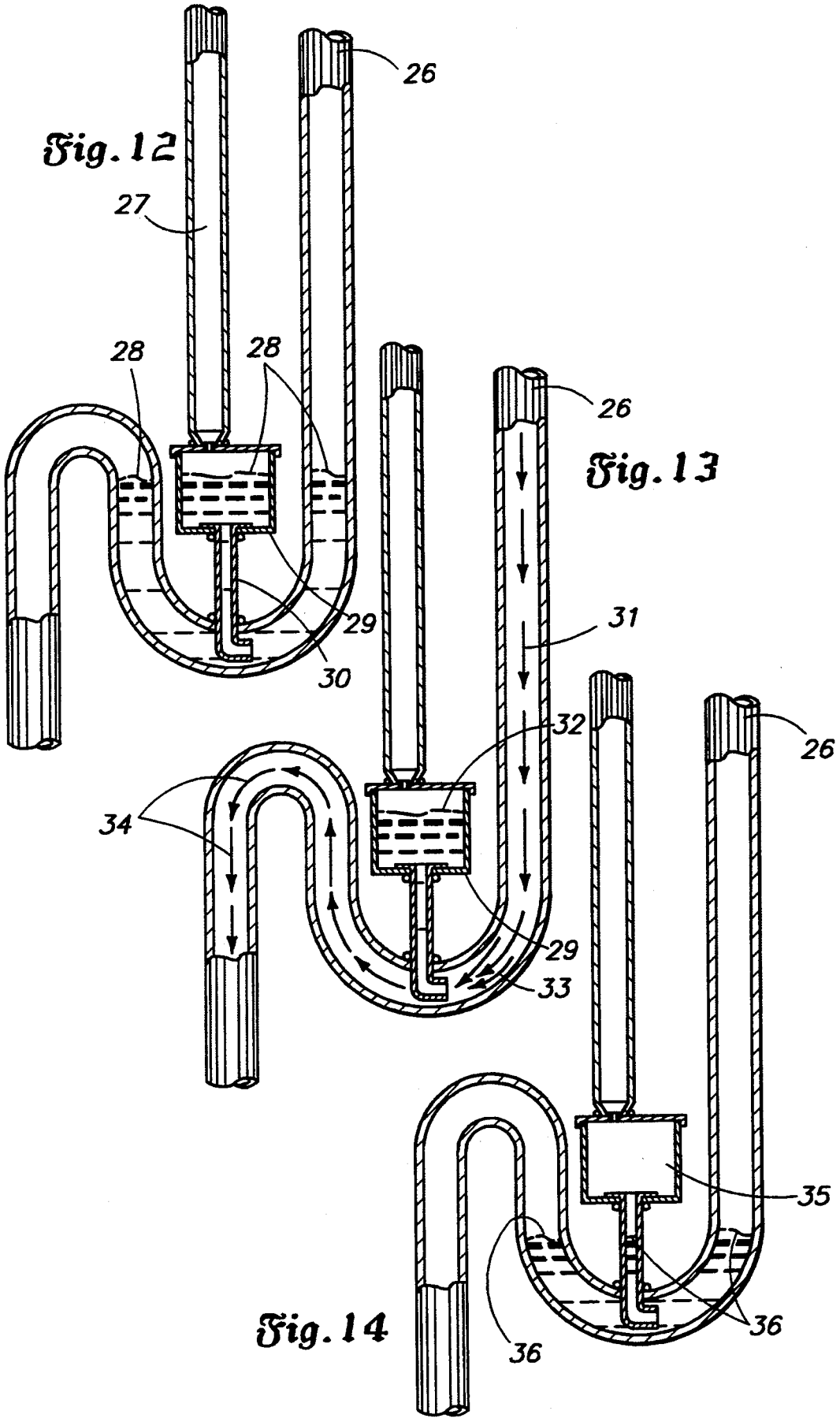
FIG. 12 is a cross section view of the Reservoir P-Trap showing water level in the P-Trap during a system off stage after a flushed use of the toilet. The P-Trap and the reservoir are filled with water, sewer gas is adequately blocked in this normal system off operational stage.
FIG. 13 is a cross section view of the Reservoir P-Trap showing water level in the P-Trap during the system on stage. Air pressure created by the activation of the system has blown water from the P-Trap allowing the exhausting of odor into the sewer vent system. Water is retained in the reservoir by the air pressure against the reservoir drain tube and vacuum on the reservoir fill tube.
FIG. 14 is a cross section of the Reservoir P-Trap showing water level in the P-Trap during a non-flushed system off stage subsequent to a dry operation of the system. With the system off the reservoir has drained into the P-Trap, replacing the water lost in the operation of the system; water that was not replaced in the P-Trap because of the user failing to flush the toilet. Draining of the reservoir into the P-Trap results in blocking sewer gas from back-flowing through the system and escaping into the indoor environment.

FIGS. 12, 13 and 14 illustrate the Reservoir P-Trap during three stages of operation. FIG. 12 indicates typical system off water levels in the Reservoir P-Trap subsequent to use of the toilet and system. FIG. 13 indicates water levels in the Reservoir P-Trap during a typical system on situation. FIG. 14 indicates the water levels in the Reservoir P-Trap subsequent to a use of the toilet when the user has failed to flush the toilet.

Referring to FIG. 12 there has been illustrated the Reservoir P-Trap. FIG. 12 represents the Reservoir P-Trap in a system off stage after typical flushed use of the toilet and ventilation system. 26 indicates the Reservoir P-Trap which is attached to the PVC pipe on the exhaust side of the fan housing indicated at 5 on FIG. 1. 27 indicates the reservoir refill tube. 28 indicates the water level in the Reservoir P-Trap subsequent to a typical flushed use of the toilet and ventilation system. 29 indicates the reservoir which retains water for refilling the P-Trap in the event that the ventilation system is used but the toilet is not flushed.

Failing to flush the toilet subsequent to use of the ventilation system would result in a standard P-Trap not being refilled with water which is used for the purpose of blocking sewer gas back-flow into the indoor environment. To prevent this problem the Reservoir P-Trap has been designed. The reservoir 29 retains water which is drained into the P-Trap if the ventilation system has operated but the user of toilet has failed to flush the toilet. The Reservoir P-Trap can be plumbed in several different configurations depending upon the volume and pressure of air operating in the system. For purposes of the prototype design of the Toilet Ventilating Manifold System, the reservoir refill tube has been plumbed between the intake side of the fan housing indicated at 5 on FIG. 1 and the toilet tank manifold indicated at 4 on FIG. 1. This plumbing arrangement provides water flow to refill said tube which drains into the reservoir and the P-Trap. This plumbing arrangement also reduces water flow through the fan housing thereby reducing fatigue on the fan and potential noise caused by water traveling through said housing during fan operation. Plumbing in this manner also provides a vacuum in said tube 27 during operation of the system. This vacuum works in conjunction with the air pressure generated in the P-Trap during operation of the system and causes retention of the water stored in the reservoir 29.

A restricted orifice at the top of the reservoir 29 and on the bottom of the reservoir refill tube 27 permits water collected in said tube to drain into the reservoir during a system off stage. Said restricted orifice also restricts vacuum created in the refill tube 27 during a system on stage. This restriction is sufficient to prevent water from being drawn out of the reservoir 29 and up said tube during operation of the system. This orifice is critical to the retention of water in the reservoir for refilling of the P-Trap if use of the ventilation system is not followed by a flushing of the toilet.

In summary of FIG. 12, after operation of the system and upon flushing of the toilet, water is diverted into the PVC pipe by the toilet tank manifold 4. A portion of this water is collected in the reservoir refill tube 27 where it drains into the reservoir 29. The remaining water diverted by the toilet tank manifold collects in the P-Trap to act as a block to sewer gas escape through the system. 30 indicates the reservoir drain tube which directs water draining from the reservoir into the P-Trap and acts as a restricting orifice which accumulates air flow to create air pressure sufficient to prevent the draining of the reservoir during a system on stage.

Referring to FIG. 13 there has been illustrated water levels and air flow in the Reservoir P-Trap during a system on stage. In this stage the fan in the fan housing indicated at 5 on FIG. 1, is operating and drawing air out of the toilet bowl and blowing it, as indicated by 31 on FIG. 13, through the Reservoir P-Trap 26. The water in the P-Trap shown on FIG. 12 at 28, has been blown into the sewer during the system on stage as indicated by FIG. 13, thereby opening the sewer gas back-flow block and clearing the way for odor to be vented into the sewer vent system. 33 indicates air pressure which in conjunction with vacuum drawn on the reservoir refill tube, indicated at 27 FIG. 12, during the system on stage as represented by FIG. 13, is causing the water stored in the reservoir 29 to be retained in said reservoir during the system on stage. Retention of the water in said reservoir is important to the prevention of back-flow of sewer gas through the system in the event of a non-flushed use of the system as indicated by FIG. 14. 34 indicates odor that has passed the Reservoir P-Trap and is being blown through the toilet base manifold and into the existing sewer vent system.

Referring to FIG. 14 there has been illustrated the Reservoir P-Trap during a system off stage subsequent to use of the toilet ventilation system after the user of the toilet has failed to flush the toilet. 35 indicates the empty reservoir from which the stored water, indicated at 32 on FIG. 13, has drained into the P-Trap after the system has shut off and the user of the toilet has failed to flush the toilet, thereby failing to provide water to refill the P-Trap which has been emptied during operation of the ventilation system, as indicated by FIG. 13. The water, as indicated by 36, that has drained from the reservoir into the P-Trap acts as the primary block to the back-flow of sewer gas into the indoor environment in the situation where the toilet has not been flushed after use of the ventilation system. The solenoid or check valve associated with the fan housing indicated at 5 on FIG. 1 acts as the secondary block. The draining of the reservoir, indicated at 29 FIG. 12, into the P-Trap as indicated by FIG. 14 provides the Toilet Ventilating Manifold System with the reliability of the P-Trap design in preventing sewer gas back-flow and qualifying said system for use under plumbing code requirements.

Having in this manner described my invention what I desire to protect by Letters Patent, and what I claim is:

1. A toilet ventilating system for use on a combination closet bowl and tank where the closet bowl has a water channel around at least a portion of the bowl periphery with openings leading from the channel to the bowl interior and where the tank is mounted on the bowl and having a passageway extending from the tank to the water channel for passage of tank water to the bowl water channel, said system comprising:

a) a tank manifold adapted to be mounted between the bowl and tank and having an access cylinder to be positioned in the passageway and an intake port communicating with said access cylinder and extending to an exterior surface of said manifold;

b) a bowl manifold adapted to be mounted between the toilet bowl and a sewer pipe, said bowl manifold having a through passageway communicating the bowl outlet with the sewer pipe and having an exhaust port leading from said bowl manifold through said passageway to an exterior surface of said bowl manifold;

c) a conduit communicating said intake port with a fan housing, another conduit communicating said fan housing through a trapway to said exhaust port, a further conduit connected to said conduit upstream of said fan housing and extending via a reservoir to said trapway, a fan located in said fan housing;

d) wherein when the toilet tank is flushed a portion of the flushing water will pass from tank through said access cylinder through said intake port through said further conduit to said reservoir and subsequently form a pool in said trapway, actuation of said fan will force said pool of water from said trapway into said exhaust port and extract air from said toilet bowl through said tank manifold, said conduit, said fan housing said another conduit into said exhaust port; upon cessation of said fan, water in said reservoir will reform a pool in said trapway.

2. A system as set forth in claim 1 wherein:

said fan is actuated by a proximity detection device.

3. A system as set forth in claim 2 wherein:

said proximity detection device is mounted on said tank manifold.

4. A system as set forth in claim 1 wherein:

said reservoir is of such a capacity that the pool of said trapway will be replenished in the absence of the tank being flushed.

* * * * *